United States Patent [19]

Kunczynski

[11] Patent Number: 4,671,186

[45] Date of Patent: Jun. 9, 1987

[54] POSITIVE DRIVE ASSEMBLY FOR AUTOMATIC, RAIL-BASED TRANSPORTATION SYSTEM

[76] Inventor: Jan K. Kunczynski, 2400 Arrrowhead Dr., Carson City, Nev. 89701

[21] Appl. No.: 741,124

[22] Filed: Jun. 4, 1985

[51] Int. Cl.[4] ..... B61B 3/00; B61B 13/02; B61B 13/12

[52] U.S. Cl. ..... 104/168; 104/89; 105/29.1; 105/148

[58] Field of Search ..... 104/18, 27, 28, 29, 104/89, 91, 118, 119, 121, 165, 168, 20; 105/29 R, 148, 149, 150, 29.1

[56] References Cited

U.S. PATENT DOCUMENTS

| | | | |
|---|---|---|---|
| 482,469 | 9/1892 | Cook | 104/168 |
| 496,188 | 4/1893 | Cook | 104/168 |
| 1,431,536 | 10/1922 | Maloney | 104/119 |
| 3,039,402 | 6/1962 | Richardson | 104/168 |
| 3,690,266 | 9/1972 | Mayo | 104/89 X |
| 3,735,710 | 7/1973 | Hickman | 104/168 |
| 3,880,088 | 4/1975 | Grant | 104/168 |
| 3,903,807 | 9/1975 | Lee | 104/168 X |
| 4,152,992 | 5/1979 | Mackintosh | 104/118 |
| 4,261,458 | 4/1981 | Bosman | 104/165 |
| 4,368,037 | 1/1983 | Limque et al. | 104/168 |
| 4,402,272 | 9/1983 | Habegger | 105/148 |
| 4,503,778 | 3/1985 | Wilson | 104/28 |

FOREIGN PATENT DOCUMENTS

| | | | |
|---|---|---|---|
| 1300029 | 6/1962 | France | 104/168 |
| 1354297 | 1/1964 | France | 104/168 |
| 183510 | 10/1983 | Japan | 104/165 |
| 2112336 | 7/1983 | United Kingdom | 104/168 |

*Primary Examiner*—Robert B. Reeves
*Assistant Examiner*—Scott H. Werny
*Attorney, Agent, or Firm*—Manfred M. Warren; Robert B. Chickering; Glen R. Grunewald

[57] ABSTRACT

An automatic, rail-based passenger and cargo transportation system which is particularly well suited for use as a moderate speed people mover is disclosed. The system includes a rail structure on which passive carrier cars are movably supported from opposite sides of the rail. In one aspect a plurality of drive wheels are rotatably mounted to the rail assembly and span across the width of the rail structure so as to drive the carrier cars along the rail in opposite directions on opposite sides of the rail. In another aspect of the invention, the carrier cars are cantilever supported from the sides of the rail so as to cause gravity biasing of the cars inwardly such that a shoe is forced into driving engagement with alternating toothed and smooth drive wheels mounted in the rail framework and sufficiently spaced so that only one toothed drive wheel interengages with the shoe assembly at any time. The people mover system further includes power transmission means which couples a plurality of the drive wheels and drive motors together for operation as a unit to provide ease of control of the multi-carrier unit system and redundancy against motor failures. Alternative drive wheel configurations and locations are disclosed, as are alternate power transmission assemblies and methods for driving passive or unpowered carrier cars along the rail structure.

4 Claims, 14 Drawing Figures

93
92
101
91
94
102
39a
39b
106
39
33
34
32
22
41
3
4C
77
79
103
104
116
117
76
43
74
23

POSITIVE DRIVE ASSEMBLY FOR AUTOMATIC, RAIL-BASED TRANSPORTATION SYSTEM

BACKGROUND OF THE INVENTION

The present invention relates, in general, to transportation systems for passengers and cargo, and more particularly, relates to moderate velocity, mass transit systems of the type commonly referred to as "people mover" systems, such as are used in airports, shopping centers, amusement parks.

Existing systems for conveying passengers and cargo over a horizontal course of moderate length at moderate speeds have ranged from moving belts or walkways, common in airports, to monorail trains, found in amusement parks, to cable driven aerial tramways, common to ski resorts, to bus or light-rail trolley systems. Each one of these transportation or people mover systems has been found to have advantages which makes its use particularly suitable for certain applications. There still exists, however, a considerable cost effectiveness gap in people mover transportations systems between the moving beltway and complex, high-technology monorail systems.

At most airports, for example, there is a substantial problem in the transport of passengers between the terminals and parking areas. A similar transportation problem exists in connection with the transport of people between stores and parking areas in large shopping centers. Moreover, the distances between parking areas and aerial tramways is often longer than is desirable in large ski resorts. In connection with the transport of freight or cargo, cargo container depots often have a transportation problem between the crane, which is loading and unloading the containers, and the storage yard.

One of the major disadvantages of the monorail type of people mover system is that the train or vehicle which rides on the monorail is usually relatively heavy because the motor which drives the system is carried by the vehicle, the train. Thus, monorail systems usually require pylons or piers which are substantial in size and spaced relatively close together to support the weight of the train. Installation of a monorail people mover system, therefore, can be very expensive, particularly when there are existing structures around which the monorail must operate. A monorail system presently being installed in a major United States city initally had an estimated cost of 45 million dollars per mile. Construction of a three mile system was started in 1983 and will not be completed until 1986, and the current estimate is that the cost of this monorail system will be approximately 75 million dollars per mile.

Moving beltways are, of course, much less costly than a monorail mass transit system, but they inherently must be operated at relatively slow speeds, e.g., 2–3 miles per hour. Moving walkway systems are particularly well suited for short distances in indoor settings, but their speed and distance limitations often result in users walking next to the beltway, rather than on it.

The principal mass transit system which currently fills the gap between beltways and monorail systems is the use of buses. It is typical at most airport installations to provide a pluralty of mini-stations or waiting areas at the terminal and throughout remote parking areas. A fleet of buses constantly circulates between these stations on a fixed route with the passengers selecting the closest stations to their respective ultimate destinations.

Such systems, however, require a plurality of operators, namely, bus drivers, as well as being limited to transport over existing or specially built roadways. Bus-based mass transport systems also tend to have insufficient capacity at peak times and undesirably high capacity during most of the rest of the time.

Another approach to the mid-distance, moderate velocity, people moving problem has been light-rail train or trolley systems. Such people movers usually have an advantage over monorail systems in that the they employ a plurality of cars or vehicles which are much lighter in weight than a single monorail train. Accordingly, the supporting track does not have the same costly support requirements that are present in monorail systems. Light rail trains or trolleys, however, have many of the disadvantages of bus-based systems in terms of the need for operators or an automatic control system. Moreover, light-rail trains also are faced with space problems in connection with obtaining right of ways for their track, particularly when the systems are retrofitted to existing structures, roadways, etc.

Automated light-rail trains inherently have control system problems and costs which increase in proportion to the number of passenger carrier cars in the system. Thus, at least some of the monorail cost savings achieved by lighter transport cars is given back in light-rail systems to operators or automatic controls.

Aerial tramways have been employed to a limited degree as general purpose people mover systems, but their use has largely been relegated to mountainous terrain and particularly ski resorts. Rope-based aerial tramways are faced with the problem of having to detach the cabins or cars to stop individual cars while the rope moves. Still further, rope-based aerial tramways are not particlarly well suited for a course in which there are horizontal curves, that is, they can go over existing structures but not easily around them. Additionally, rope tension increases with each cabin added to the system.

Other attempts to fill the gap between monorail train systems and moving walkways can be found in the patent art. Thus, in U.S. Pat. No. 3,690,266 a monorail system is disclosed in which a powered car or passenger carrier unit is suspended from beneath the monorail. In U.S. Pat. No. 3,735,710 a passive or unpowered passenger carrier unit is propelled along a track by a plurality of drive wheels which engage both sides of the vehicle to sequentially advance the passenger carrier unit along the track. Similarly in the system disclosed in U.S. Pat. No. 3,903,807, a plurality of drive wheels are positioned underneath a passive passenger carrier vehicle so as to sequentially drive the vehicle along a path of drive units. In U.S. Pat. No. 4,503,778, unpowered vehicles are supported from a track and then propelled by drive wheels which positioned proximate the track engage a rail or keel beneath the vehicle. U.S. Pat. No. 3,039,402 discloses a powered wheel which is positioned proximate a railroad track is used to drive railroad cars during switching operations.

Such prior patented people mover systems, however, generally have not been commercially exploited to any significant degree. They inherently include certain disadvantages in construction or operation. Thus, some of the systems are undesirably complex, others require bulky track or rail structures, and still others are powered inefficiently.

Accordingly, a gap in moderate velocity, moderate distance, people mover systems still remains between a monorail or light-rail trains and moving walkways.

OBJECTS AND SUMMARY OF THE INVENTION

A. Obiects Of The Invention

Accordingly, it is an object of the present invention to provide an automated, rail-based transportation system which has a high capacity to transport passengers and cargo over moderate distances at moderate speeds.

It is a further object of the present invention to provide a people mover apparatus and method which may be readily adapted or retrofitted to existing structures and which requires a minimum right-of-way.

Another object of the present invention is to provide a people mover apparatus and method which can be automatically operated without the need for an operator or driver at each vehicle or passenger carrier unit.

It is still a further object of the present invention to provide a people mover apparatus and method in which passive passenger carrier units are propelled along a support rail in a highly efficient and positive manner so that their movement can be subject to automatic control.

Still a further object of the present invention is to provide a people mover system in which a single support rail structure can be used for two way traffic of unpowered vehicles so as to minimize the right-of-way requirements for the system.

Another object of the present invention is to provide a people mover apparatus and a method in which the passenger carrier units may be very light in weight and externally powered by a highly efficient drive assembly.

Still another object of the present invention is to provide a people mover system having a drive assembly in which there can be conservation of naturally available energy for use in driving other portions of the system.

It is still a further object of the present invention to provide a people mover system which is reliable and efficient in operation, durable, relatively inexpensive to construct and operate, easy to maintain and repair, and safe for automated operation.

The automatic rail-based transportation system of the present invention has other objects and features which will be apparent from the accompanying drawing and/or are set forth in more detail in the following description of the preferred embodiments.

Summary Of The Invention

The automatic, rail-based passenger and cargo carrying transportation system of the present invention is comprised, briefly, of a rail or track structure which extends horizontally over a course or route and is formed for support or movement of a plurality of load carrier units along the rail; at least one, and preferably a plurality of passive load carrier units movably supported from the rail; and at least one, and preferably a plurality of drive wheels rotatably mounted proximate the rail and positioned to engage and drive the passive carrier units along the rail. In one aspect of the transportation system of the present invention the rail structure is formed for movable support of passive carrier units from opposite sides of a single rail structure, and the drive wheels are dimensioned to span transversely across the rail structure so that a given wheel can drive the load carrier units in opposite directions on opposite sides of the rail structure. In another aspect of the present invention, the passive passenger carrier units are cantilevered from the sides of the rail structure for gravity biasing of the units on the rail structure into cooperative engagement with the drive wheels to ensure driving of the units along the rail. In still a further aspect of the present invention, the people mover system includes a power transmission assembly positively coupling all of a plurality of drive wheels and drive motors together, preferably by a system of V-belts or right-angle differentials and drive shafts, to provide ease of control of the system and redundancy and continued operation notwithstanding failure of a motor in the power transmission assembly.

The method of transporting passengers and cargo of the present invention along a course by a rail structure and passive carrier unit driven by outside drive assemblies associated with the rail comprises, briefly, the step of supporting the carrier unit cantilevered from a side of the rail to produce a gravity induced moment about the rail biasing the carrier unit into driving contact with the drive assemblies. In a second aspect of the method of transporting cargo and passengers of the present invention, the method includes the step of driving the carrier unit along opposite sides of a rail structure by a common drive wheel formed to engage the unit on both sides of the rail to thereby drive the unit in opposite directions on opposite sides of the rail by means of a single drive wheel.

DESCRIPTION OF THE PREFERRED EMBODIMENTS

Figure 1:
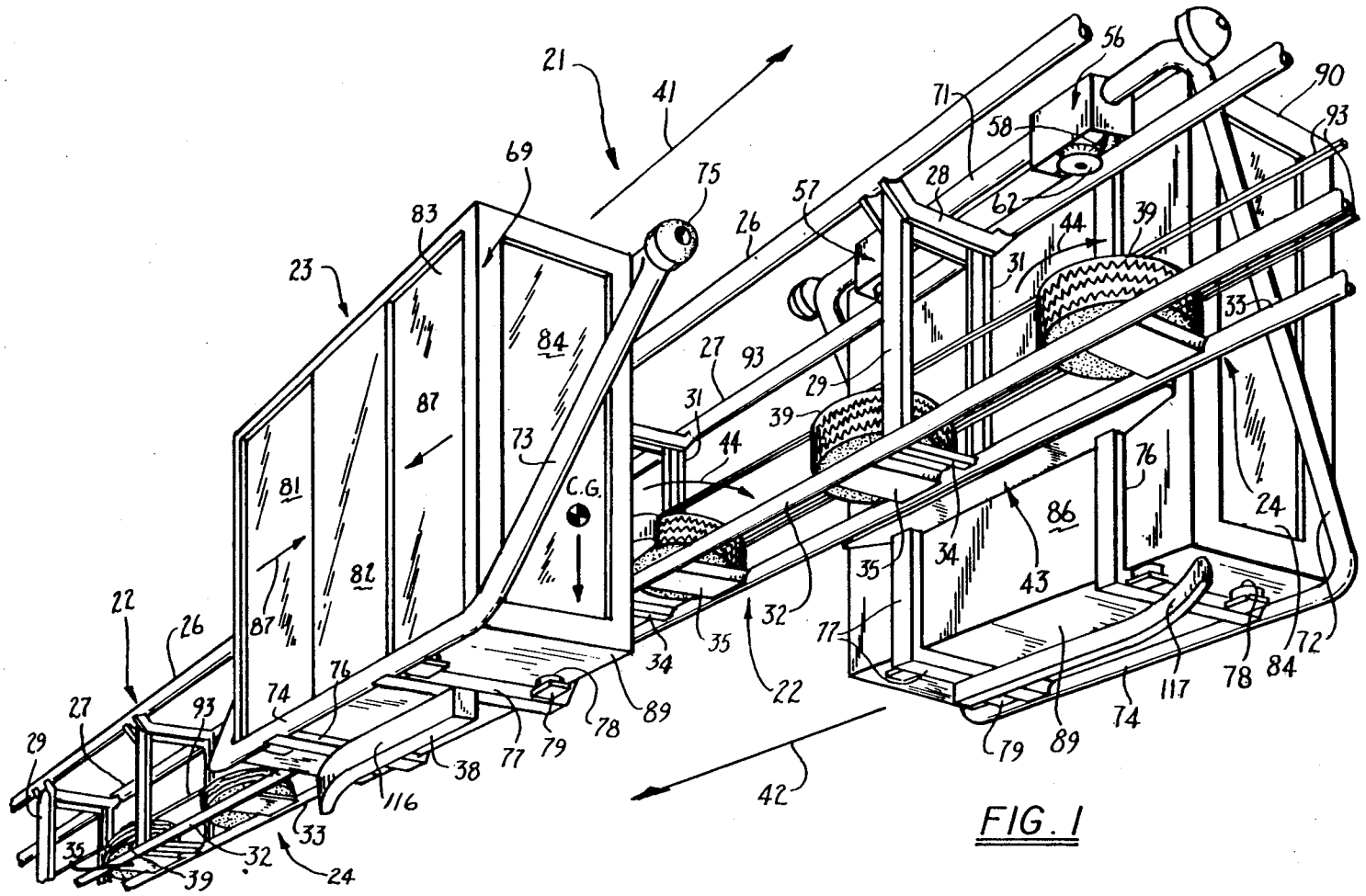
FIG. 1 is a bottom perspective view of an automatic, rail-based transportation system constructed in accordance with the present invention.

The improved passenger and cargo transportation system of the present invention makes use of relatively lightweight, passive or unpowered carrier units which are driven at moderate speeds along a relatively lightweight rail structure by a plurality of drive wheels mounted to the rail. The people mover system fills a gap between slow moving walkways or beltways and more rapid but complicated light-rail trolley systems or monorail systems.

The people mover system of the present invention, generally designated 21, is comprised of three major components, namely, rail means, generally designated 22, at least one and preferably a plurality of carrier units, generally designated 23, and drive means, generally designated 24, that is positioned proximate and preferably on rail means 22.

It is broadly known in the art to transport passengers and cargo by means of a rail-based transport system in which a plurality of passive or unpowered carrier units 23 are driven along the rail by drive wheels, see e.g., U.S. Pat. Nos. 3,735,710 and 4,503,778. In the people mover system of the present invention, however, a unique combination of the rail structure and carrier units is provided in which two-way transport of the carrier units along opposite sides of a unitary rail assembly can be readily accomplished. Moreover, suspension of the carrier units from the rail and the transmission of driving power along the rail provides a people mover system which can be readily adapted to automatic operation and which has greatly improved reliablity, efficiency, and cost effectiveness.

Two-Way Rail and Drive Assembly

An important aspect of the automatic, rail-based transportation system of the present invention is the provision of a highly efficient structure for two-way driving of passive passenger carrier units along a single rail structure. As best may be seen in FIGS. 1 and 3, rail means 22 preferably is formed as an open framework including a pair of side by-side rails 26 and 27 which extend longitudinally and are supported by a framework to provide support surfaces on opposite sides of the rail structure. The support rails 26 and 27 are joined by laterally connecting framework members 28, and depending downwardly from the transverse connecting members 28 are pairs of vertical frame elements 29 and 31. The box-like structure is completed by lower longitudinally extending rails 32 and 33 with connecting transverse members 34 positioned periodically along the length of rail means 22.

The open box-like framework comprising rail means 22 is preferably mounted in an elevated orientation over a support surface, such as the ground, by columns or towers 36 (FIG. 7) which are positioned along the length of the rail means in accordance of the load requirements of the rail and load carrying units 23.

It is an important advantage of the open framework rail structure 22 that support columns 36 need not be massive. Since the load carrier units or cars are passive, they do not carry the weight of a motor or propulsion system. Moreover, the car propulsion system in the transit system of the present invention is spaced along the length of rail structure 22, as will be more fully described hereinafter, so that the propulsion system weight is more evenly distributed along the length of the rail. Still further, the propulsion system which is employed does not require drive motors at every drive wheel, allowing strategic location of motors 37, for example, on motor mounting plates 35 proximate columns 36, if desired. As will be appreciated and is described more fully hereinafter, motors can be readily positioned intermediate columns 36.

As will also be understood, rail structure 22 is suitable for use in underground installations in which the rail would not be "elevated" with respect to the ground. Similarly, the vertical height of framework members 29 and 31 can depend sufficiently down from rails 26 and 27 so that the frame members extend below the lowermost surface 38 of carrier units 23 for support of the rails directly on a support surface without need for columns 36.

In order to provide two-way driving of passenger carrier units 23 on the transport rail means 22 of the present invention, system 21 preferably further includes drive means 24 having at least one drive wheel 39 dimensioned and positioned to engage and drive unit 23 in a first direction (as indicated by arrow 41 in FIG. 1) when the unit is on one side of rail structure 22, and in a second direction (as indicated by arrow 42) when the unit is movably supported on an opposite side of rail structure 22.

Figure 3A:
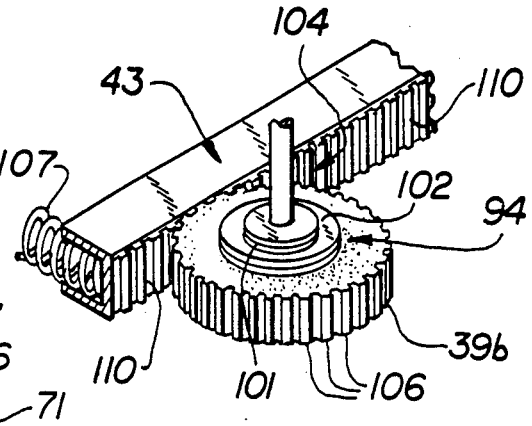
FIG. 3A is an enlarged, fragmentary, top perspective view of one form of drive wheel and drive shoe suitable for use with the transportation system of FIG. 1.
Figure 3:
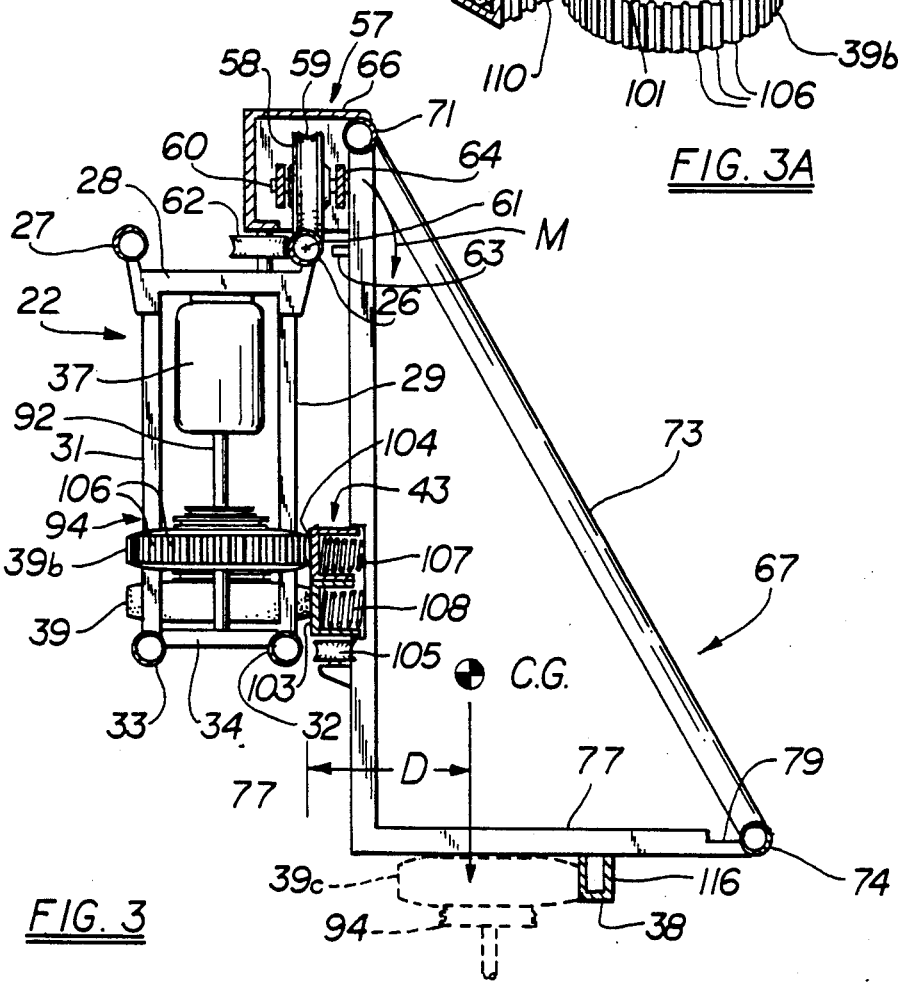
FIG. 3 is an end elevation view, in cross-section, of the frame and rail structure taken substantially along the plane of line 3—3 in FIGS. 2 and 4B.

As will be seen from FIGS. 1 and 3, drive wheels 39 are preferably mounted periodically along the length of rail means 22 for rotation about a vertical axis with the drive wheel generally horizontally oriented. Drive wheel 39 is dimensioned so that the perphery of the drive wheel extends laterally outwardly of the sides of rail means 22, and particularly vertical frame members 29 and 31, so as to protrude for frictional engagement with a drive shoe assembly 43 secured to the passenger carrier units. Shoe assembly 43 preferably includes a surface 103 which extends along substantially the entire length of the passenger carrier unit. Thus, as drive wheels 39 rotate in the direction of arrow 44, they engage the drive shoe assemblies of the passenger carrier units on opposite sides of the rail structure and drive the units in opposite directions along rail means 22.

This two-way drive assembly allows the transportation system of the present invention to be employed on right-of-ways which are relatively narrow. Thus, light-rail or trolley systems which heretofore have been employed usually require two side-by-side tracks, and monorail systems of the type conventionally employed have either been constructed with loop layouts and trains moving in one direction or a shuttle system in which the train direction is reversed along the rail or track.

Figure 5:
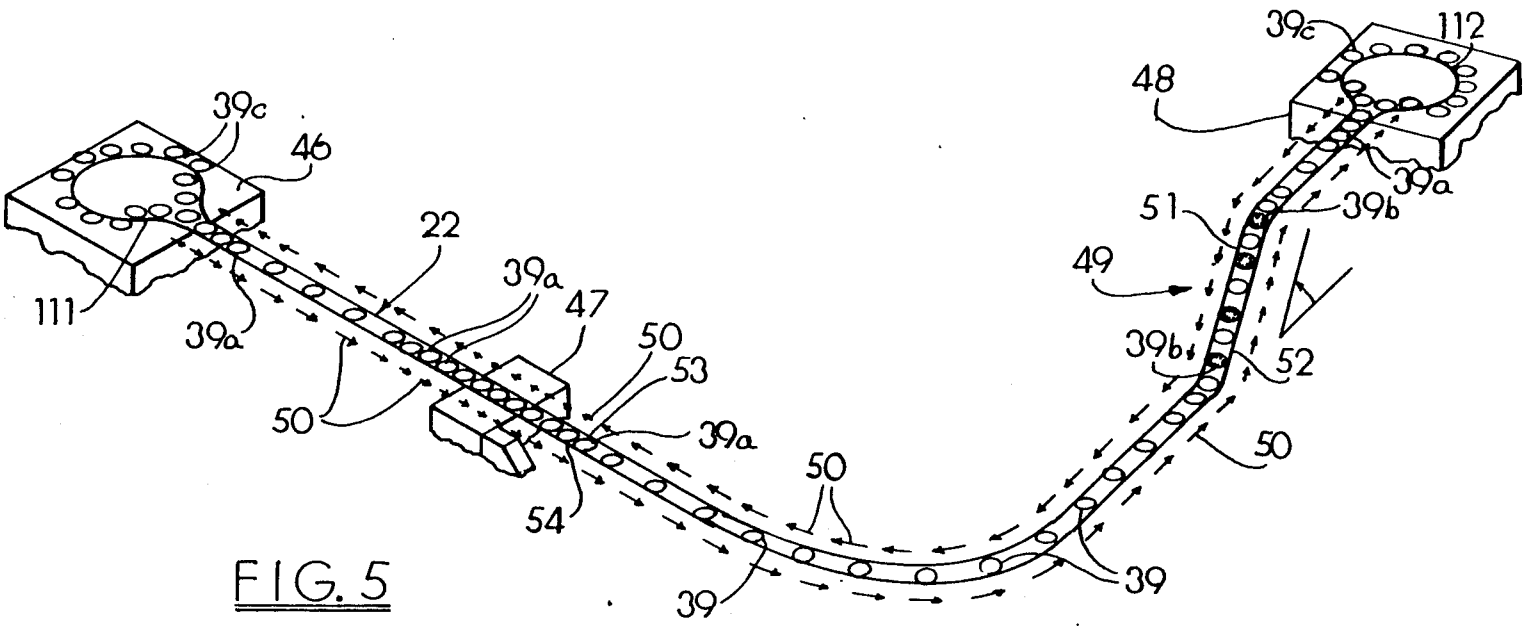
FIG. 5 is a top perspective schematic representation of a typical course or track layout for the transportation system of FIG. 1.

A substantial advantage occurs from being able to simultaneously drive both carrier units 23 in opposite directions along rail 22 with a single drive wheel. Acceleration and deceleration of the passenger units often occurs at approximately the same position along the length of the two-way rail and drive assembly. Referring to FIG. 5, passenger carrier units will be seen by the length of arrows 50 to accelerate on one side of the rail and decelerate on the opposite side of the rail proximate stations 46, 47 and 48. Additionally, areas in which there is a grade or elevation change, for example at 49, will produce gravitational acceleration on one side 51 of the rail and gravitational deceleration on the other side 52 of rail 22. Use of a single drive wheel which spans between the sides of rail means 22 allows the energy available by gravitation of the passenger carrier units on downside 51 to be transmitted through the common drive wheels 39 to the upwardly sloping side 52 of the rail. Similarly, deceleration along side 53 proximate a station, for example station 47, can be used to accelerate units out of station 47 along side 54 of the track or rail structure 22.

As will be more fully described hereinafter, positive coupling of the various drive wheels together longitudinally along rail 22 by power transmission means allows this conservation of acceleration and deceleration energy even though the units are not simultaneously being driven by exactly the same drive wheel 39. Gravitational acceleration of a unit 23 at the top of incline 49 provides energy into the series of drive wheels 39 that will be transmitted by power transmission means to a unit at the bottom of the incline.

Support Assembly for Carrier Units

The people mover system of the present invention further includes an improved support assembly for movable support of the passenger cars from rail means 22. The support assembly is formed for cantilevered, rolling support of units 23 from opposite sides of rail structure 22, with units 22 being gravity biased into cooperative engagement with drive means 24 to ensure driving of the units along the rail.

Figure 2:
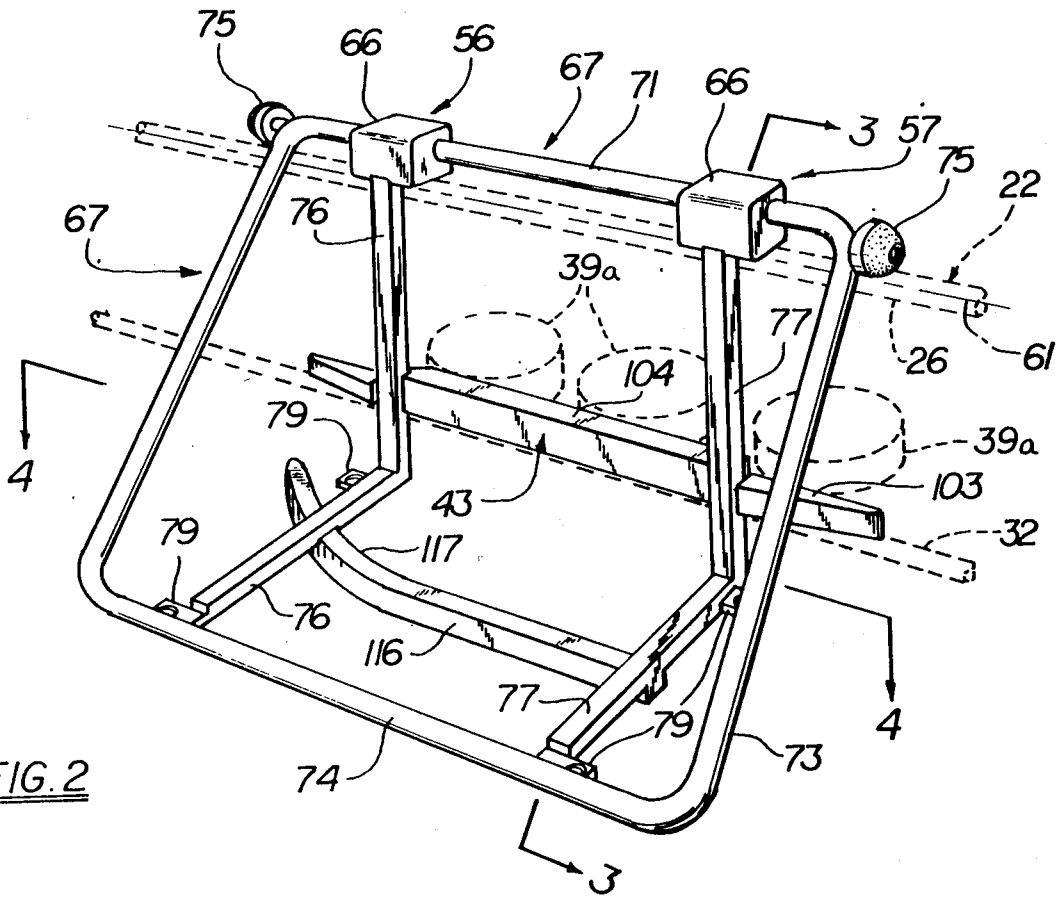
FIG. 2 is a top perspective view of the carrier unit frame of the carrier units shown in FIG. 1.

As best may be seen in FIGS. 2 and 3, passenger and cargo carrying units 23 preferably include a roller assembly, in this case two roller assemblies 56 and 57, formed for rolling movement of the passenger carrier unit along rails 26 and 27. The roller assemblies are cooperatively formed not only for rolling movement along the length of the rail, but also for lateral pivotal movement about the longitudinal axis 61 of rails 26 and 27. As best may be seen in FIG. 3, this freedom to pivot laterally can be provided by forming rails 26 and 27 with a circular cross section and providing roller assemblies 56 and 57 with a sheave 58 having a mating concave surface 59 which will permit pivoting about the central longitudinal axis 61 of the rail. Roller assemblies 56 and 57 further preferably include a second rotatably mounted sheave 62 which engages a side of rail 26 and is also concaved so as to permit lateral pivotal movement about rail 26. The sheave 62 resists the tendency for the roller assembly to be pulled laterally off rail 26. Most preferably, the assembly further includes stop means 63 on the inward side of rail 26 to prevent derailment of roller aassembly from the support rail. Additionally, auxilliary sheave 105 can be provided on the frame of the unit to engage lower rail 32 (FIG. 3) and limit pivotal movement about rail 26. Sheave 58 may be mounted for rotation about axle 60, which in turn is coupled by support flanges 64 to assembly housing 66.

In order to provide a high strength and yet lightweight structure for the passenger carrier unit of the people mover system of the present invention, it is further preferable that the passenger carrier unit include a load bearing frame, generally designated 67, coupled to roller assemblies 56 and 57 and formed to support the load to be transported. In the preferred form a cabin 69 having side walls defining a space suitable for holding passengers and/or freight or cargo is mounted to frame 67. Most preferably frame 67 is external to any cabin or platform means positioned on the frame, and cabin 69 can be removed from the frame for replacement with a passenger or cargo carrier unit having a different configuration. When the transport system of the present invention is employed for cargo, for example, exterior frame 67 can be used to support a platform having no side walls upon which palates carrying cargo can be supported. Alternatively, cabin 69 can be replaced by a removable container, with frame 67 being dimensioned for support of cargo containers presently in widespread use in the shipping and trucking industries.

As will be appreciated from the drawing, the center of gravity, C.G., of the car or carrier unit will be positioned laterally outwardly of rails 26 and 27 by distance, D, which will induce a moment of inertia about longitudinal axis 61 of the support rails. Thus, arrow M in FIG. 3 shows the moment about axis 61 that results from the cantilevered support of the passenger carrier unit on the outward side of rail 26. Moment, M, therefore, gravity biases unit 23 to swing inwardly toward rail means 22 and drive wheels 39.

In the preferred form, frame 67 includes a longitudinally extending frame portion 71 spanning between roller assemblies 56 and 57, diagonally downwardly depending frame portions 72 and 73, and longitudinally extending connecting frame portion 74, preferably formed from a single structural member. Depending downwardly from roller assembly housing 66 are L-shaped frame members 76 and 77 to which longitudinally extending drive shoe assembly 43 is secured. In order to provide a cushioned ride for passengers and freight, it is preferable to mount the cabin or platfom means 69 to frame 67 by resilient mounting means 78 which are supported on frame mounting flanges 79.

Optionally, frame 67 also may be provided with bumpers 75 which are resilient and minimize any slight impact which might occur when cars are in close proximity, for example, in a station.

Figure 7:
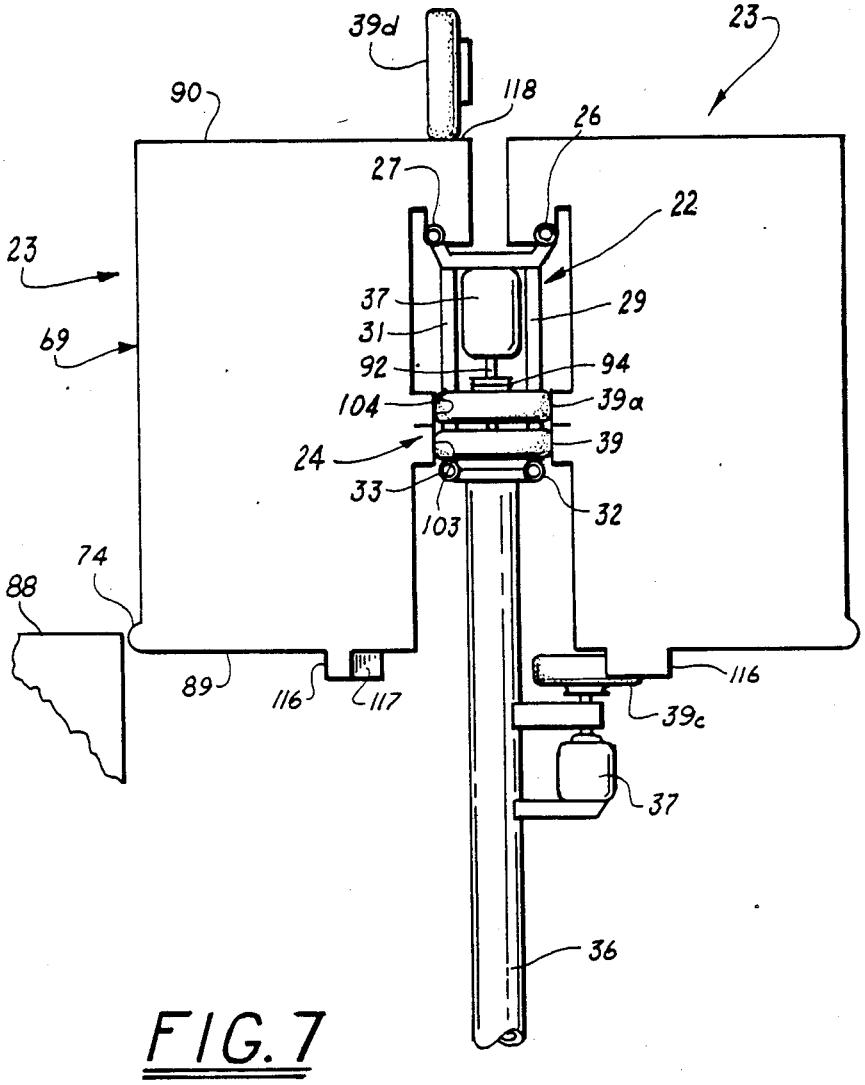
FIG. 7 is a schematic, end elevation view of the rail structure and carrier units of FIG. 1 showing alternative drive wheel locations.

Passenger carrier unit 23, as illustrated in FIG. 1, is preferably formed with a cabin including three front panels 81, 82 and 83, side panels 84, rear panel 86 floor 89 and roof 90. For passenger ingress and regress, panels 81 and 83 are preferably sliding panels which move in a direction indicated by arrows 87 behind central panel 82 to provide two entrance and exit openings to the cabin. Panels 81–84 may all advantageously include transparent portions to allow the passenger to look out of the cabin as he is being transported. Cabins 69 can also include a seat structure and/or baggage storing shelves, depending upon the application to which the people mover system is being employed. As may be appreciated, and as best seen in FIG. 7, the stations for loading and unloading will include a platform 88 positioned at about the level of floor 89 or lower frame portion 74 to permit unimpeded boarding and unloading over lower frame portion 74.

Power Transmission Assembly

In a further aspect of the present invention the people mover system includes a power transmission assembly which is particularly easy to control and yet highly efficient and reliable in driving the passive passenger carrier units along rail means 22. A problem which is constantly encountered with a plurality of independently powered vehicles or passenger carrier units is that they breed control problems which makes safe automatic operation difficult and costly to obtain. When there are a plurality of units running on the same track, failure of any one of the units creates immediate control problems with respect to all of the other units. Passive load carrying units in the transportation system of the present invention, however, will all act in unison and under one control since the drive means for the system is coupled together by power transmission means as a unit. Moreover, the power transmission system employed in the people mover apparatus in the present invention provides a redundancy which permits a continued and uninterrupted operation, notwithstanding failure of one or more drive motors.

Figure 4A:
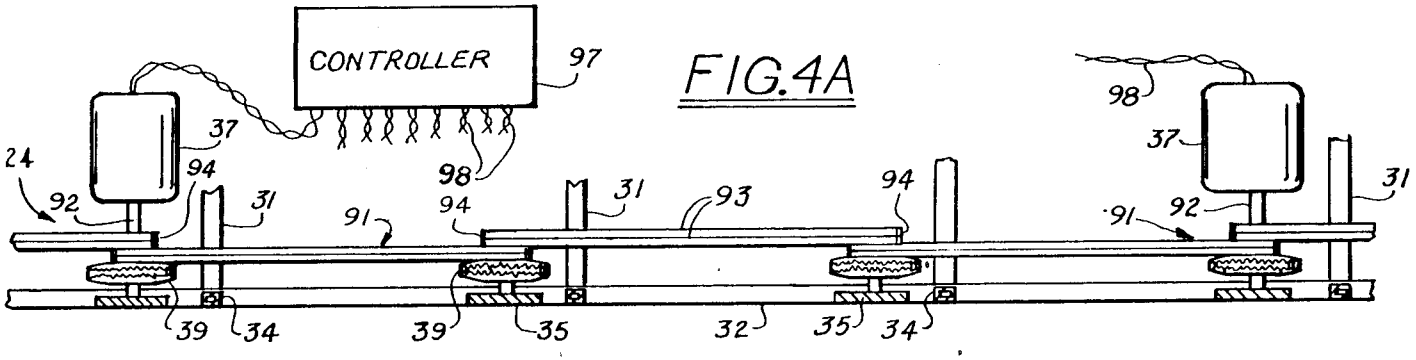
FIG. 4A is a side elevation view of the drive wheel assembly of FIG. 4 taken substantially along the plane of line 4A—4A in FIG. 4.
Figure 4:
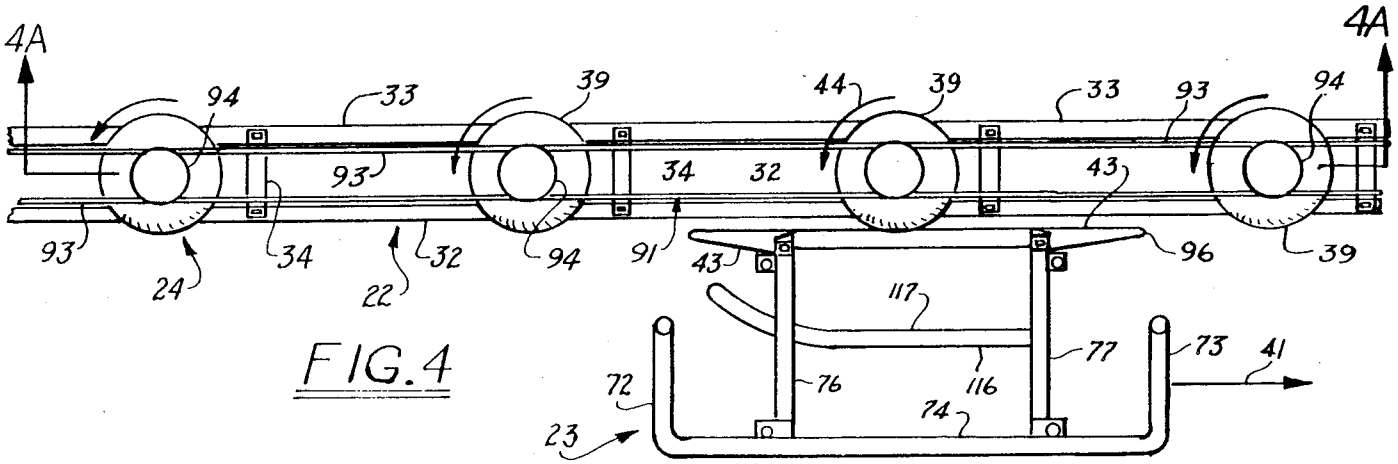
FIG. 4 is a top plan view, in reduced scale and in cross-section, taken substantially along the plane of line 4—4 in FIG. 2.

In FIGS. 4 and 4A drive means 24 with power transmission means, generally designated 91, is shown positively coupling together a plurality of drive wheels 39 for driving the passenger carrier units at a constant velocity along track or rail means 22. A plurality of drive motors 37 are positioned along the length of rail structure 22 and coupled through drive shafts 92 to wheels 39. As will be seen in FIG. 4A, it is contemplated that a motor 37 will not be provided at each of drive wheels 39, although in some forms of the transportation system of the present invention motors 37 will be provided at each drive wheel 39. However, often motors 37 are positioned along the length of the rail means framework, power transmission means 91 will be used to couple a plurality of drive wheels and motors together for operation as a unit.

Coupling of motors 37 together by transmission means 91 greatly simplifies control problems which would exist in a system having a plurality of cars or units 23. Additionally, transmission means 91 provides redundancy as well as ease of control.

In the preferred form of the present invention, power transmission means 91 includes at least one V-belt 93 (in this case two V-belts) mounted to pulley assemblies 94 at motors 37. Pulley assemblies 94 are coupled for rotation with drive shafts 92 so that power is transmitted from one motor 37 to adjacent motorless drive wheels 39 and thereafter to the next motor. Since pulley assemblies 94 are formed in FIG. 4A as two sets of pulleys of the same diameter, each of the drive wheels 39 along the section of rail shown in FIGS. 4 and 4A will be driven at the same speed. Thus, carrier unit 23 is advanced along the rail at a constant velocity.

In order to minimize the number of drive wheels required to propel the passive carrier units of the present invention while still maintaining positive control over the advancement of the units on the rail structure, the drive wheels 39 are preferably positioned along rail 22 at a distance slightly less than the length of drive shoe assembly 43. At any given time, therefore, the periphery of at least one drive wheel 39 is in driving engagement with shoe assembly 43. The spacing of drive wheels 39 along the length of rail 22 will also depend upon the loading of the passenger carrier unit. Since the cantilevered support tends to produce a moment inwardly toward the rail, the front end 96 of shoe 43 cannot be cantilevered longitudinally from drive wheel 39 to such a great distance that the weight of the loaded carrier unit 23 will cause the front end 96 to be displaced inwardly toward the rail structure to too great an extent. The provision of pairs of roller assemblies 56 and 57 positioned in spaced apart relation along the length of frame portion 71 limits, however, the inward displacement of the drive shoe about the drive wheel toward the rail framework.

It is further preferable that the horsepower of the drive motors 37 be selected so that failure of any given motor 37 will merely result in the motor acting as an idler drive wheel. Thus, the two adjacent motors on the upstream and downstream side of the failed motor will drive the wheels 39 all along the length of the rail, including the wheels which would normally be driven by the failed motor. This allows uninterrupted operation of the system until repairs can be made. The control unit 97 which is coupled by electrical conductors 98 to each of motors 37 slaves, with power transmission means 91, all the motors together for operation as a unit. Thus, if the speed of the system is to be reduced by one half, all of the motors are slowed by controller 97 to one half of their operating speed, including the motors in the accelerators and decelerators, as will be discussed in more detail hereinafter. It is relatively easy to further provide indicator lights which will alert a central operator to the failure of a particular motor 37, while the entire system continues to operate. Repairs on the failed motor can be accomplished at off-peak hours when it will be possible to shut down or greatly reduce the speed of the system.

Figure 9:
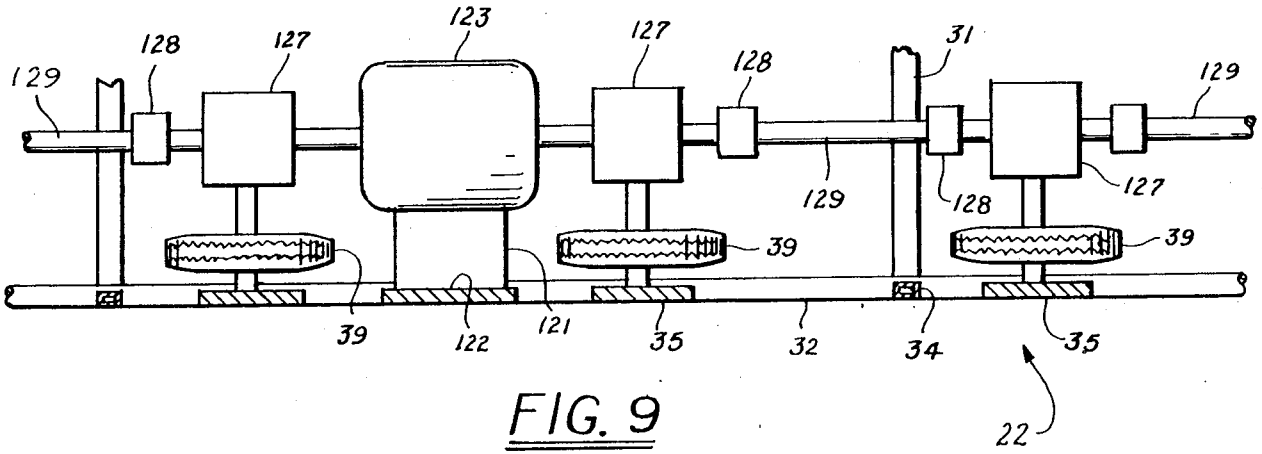
FIG. 9 is a fragmentary, side elevation view corresponding to FIG. 4A of an alternative embodiment of the power transmission assembly of the present invention.

An alternative embodiment of power transmission means 91 is shown in FIG. 9. Mounted to rail means 22 by motor mount 121 and cross brace member 122 is a double ended, horizontally oriented motor 123. Each output shaft 124 and 126 of motor 123 is coupled to a right angle gear box 127. Gear boxes 127, in turn, can be connected together through flex couplings 128 and drive shafts 129.

As will be apparent, gear boxes 127 can contain gears which maintain a constant velocity of drive tires 39 along rail means 22 or provide acceleration/deceleration. Thus, the gear box-drive shaft construction of FIG. 9 can be used in place of a V-belt assembly to positively couple a plurality of motors 127 together along rail 22 to facilitate the control of multiple cars and provide system redundancy. Obviously, combinations of V-belts and drive shafts also can be employed.

Acceleration and Deceleration Assemblies

Figures 4B, 4C, 8:
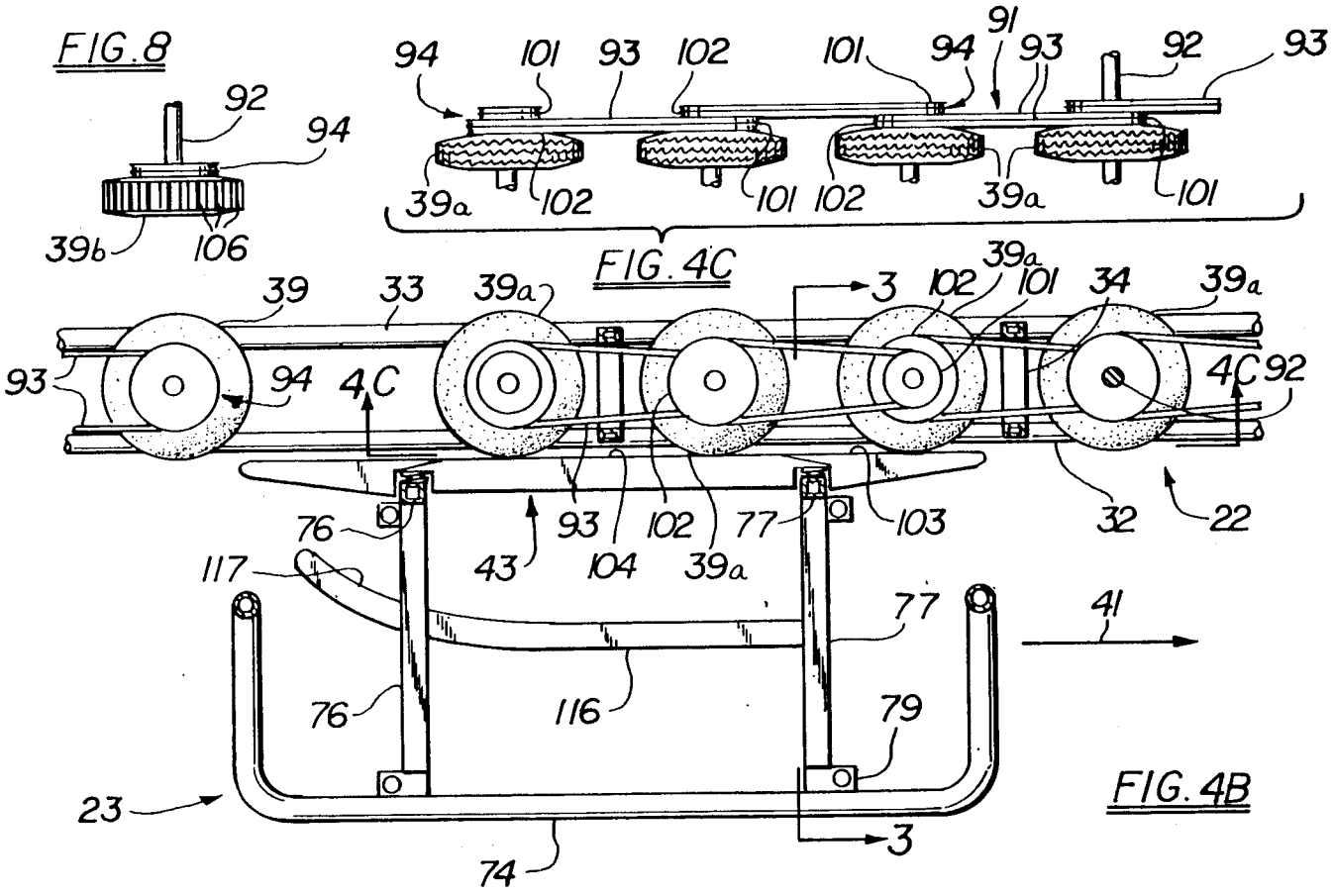
FIG. 4B is a top plan view corresponding to FIG. 4 but in a larger scale and showing accelerator/decelerator portion of the drive assembly.
FIG. 4C is a side elevation view of the drive wheel portion assembly of FIG. 4B.
FIG. 8 is a fragmentary, side elevation view of a toothed drive wheel suitable for use in the transportation system of the present invention.

In order to provide for acceleration and decelaration of the passive carrier units 23, the drive means of the people mover system in the present invention preferably includes a plurality of acceleration and deceleration drive wheels which engage an acceleration surface on drive shoe assembly 43. As best may be seen in FIGS. 4B and 4C, drive wheels **39*a* are coupled together by power transmission means 91, which includes pulley asssemblies 94 in which there are two sets of pulley grooves having differing diameters. Mounted between alternating sets of small and large diameter pulley grooves are V-belts 93. As shown in FIGS. 4B and 4C the righthand most pulley is coupled by shaft 92 to a drive motor (not shown). Since V-belts 93 are mounted to the small set 101 of pulley grooves on the motor driven drive wheel 93*a* and a large diameter set of pulley grooves 102 on the next drive wheel 39*a* to the left, the drive wheel to the left will be operating at a speed which is somewhat slower than the driven drive wheel 39*a***. Similarly, the stepped sets of pulley assemblies gradually reduces the speed of operation of each of the wheels moving from far right to far left.

As shown in FIG. 4B, therefore, carrier unit 23 is decelerated along the righthand side of rail means 22, as for example would occur when the carrier unit enters a station, and the same drive wheels **39*a* would be accelerating a carrier unit operating on the opposite side of rail 22 out of the station and up to a speed at which constant speed drive wheel 39 shown on the lefthand side of FIG. 4B**.

In order to get smooth acceleration over a reasonably short distance, it is preferable to space the same acceleration/deceleration drive wheels 39*a* along rail means 22 at relatively close intervals and to provide a relatively short drive shoe surface on the passenger carrier unit. FIGS. 2, 3 and 4B show a drive shoe assembly 43 having a lower surface 103 which is engaged by constant speed drive wheel 39 and upper or second surface 104 which is shorter and is engaged by acceleration/deceleration drive wheels 39*a*.

It is desirable to have the constant speed drive shoe surface 103 relatively long so that the constant speed drive wheels can be spaced relatively far apart. When accelerating, however, the acceleration occurs only when driving shifts from the slower of drive wheel 39*a* to the next adjacent faster moving drive wheel 39*a*.

As the acceleration/deceleration drive shoe surface 104 enters the set of accelerator/decelerator drive wheels 39*a*, surface 104 is engaged and the speed of the car drops or accelerates to the speed of the first drive wheel 39*a*. When the front end of the surface 104 engages the next accelerator/ decelerator wheel 39*a* it initially slips until the rear surface of surface 104 is advanced past the first drive wheel, at which point the unit is decelerated to the speed of the second acceleration/deceleration drive wheel 39*a*. This process of initial slipping and then driving control continues as the unit is advanced along the accelerator/decelerator and each of the drive wheels sequentially assumes control over the rate of advancement while the other drive wheel gradually looses control and begins to slip until it is out of engagement with the surface 104.

For most installations, the people mover system of the present invention can employ drive wheels and acceleration/deceleration wheels 39*a* which merely frictionally engage drive shoe assembly 43. Thus, pneumatic tires 39 and 39*a* can be employed as drive wheels to engage shoe assembly 43 which has surfaces 103 and 104 that are formed to have a relatively high coefficient of friction.

In some installations, however, there may be a grade or slope of the rail means 22 which will make frictional driving of the passenger carrier units less positive. Similarly, in installations requiring rapid acceleration or deceleration, a more positive engagement between the drive wheels and the passenger carrier units may be desirable.

FIGS. 3, 3A and 8 illustrate drive wheels 39*b* which are formed with teeth 106 that can mate with teeth 110 or openings in either or both of surfaces 103 and 104 in drive shoe assembly 43. The drive shoes advantageously may be formed with openings or slots (not shown) which mate with the teeth 106 so that the drive shoes can be the basis for propelling the carrier unit by either a smooth drive wheel 39 or a drive wheel 39*b* having teeth or protusions 106 which will positively engage the openings in shoe 43.

One of the problems in connection with employing drive wheels which have teeth or protrusions is that during the short period of time that two wheels are engaged with one of drive surfaces 103 and 104, the teeth on the respective wheels can fight each other in attempting to mesh with the slotted or toothed shoe 43. Accordingly, it is a further feature of the people mover system of the present invention that, when it employs toothed drive wheels, the drive wheels are positioned at every other location along the drive rail. In FIG. 5, for example, the first, third, fifth, seventh and ninth wheels 39*b* in inclined section 49 would be toothed, while the second, fourth, etc. would be smooth wheels 39. This construction avoids contact at the same time by two toothed drive wheels and thereby prevents fighting between the wheels for registration with the mating structure in drive shoe assembly 43.

In order to provide some resiliency and afford a smooth propulsion of the carrier units 23 along rail 22, it is further preferable that drive shoe assembly 43 be spring mounted to frame 67 of load carrying unit 23. Thus, shoe assembly 43 can be provided as a pair of shoes each biased by springs 107 and 108 outwardly from vertical frame members 76 and 77 toward drive wheels 39. Thus, the combination of the drive tires 39, preferably being pneumatic or at least resilient, and the resilient mounting of drive shoe assembly 43 to the frame, as well as the ability of frame 67 to pivot about longitudinal axis 61 of the support rail allows the passive carrier unit to be propelled down the rail with dimensional variances and dynamic load shifting and the like being accommodated by a combination of resiliency and pivoting.

Loop Assemblies

Figures 6, 6A:
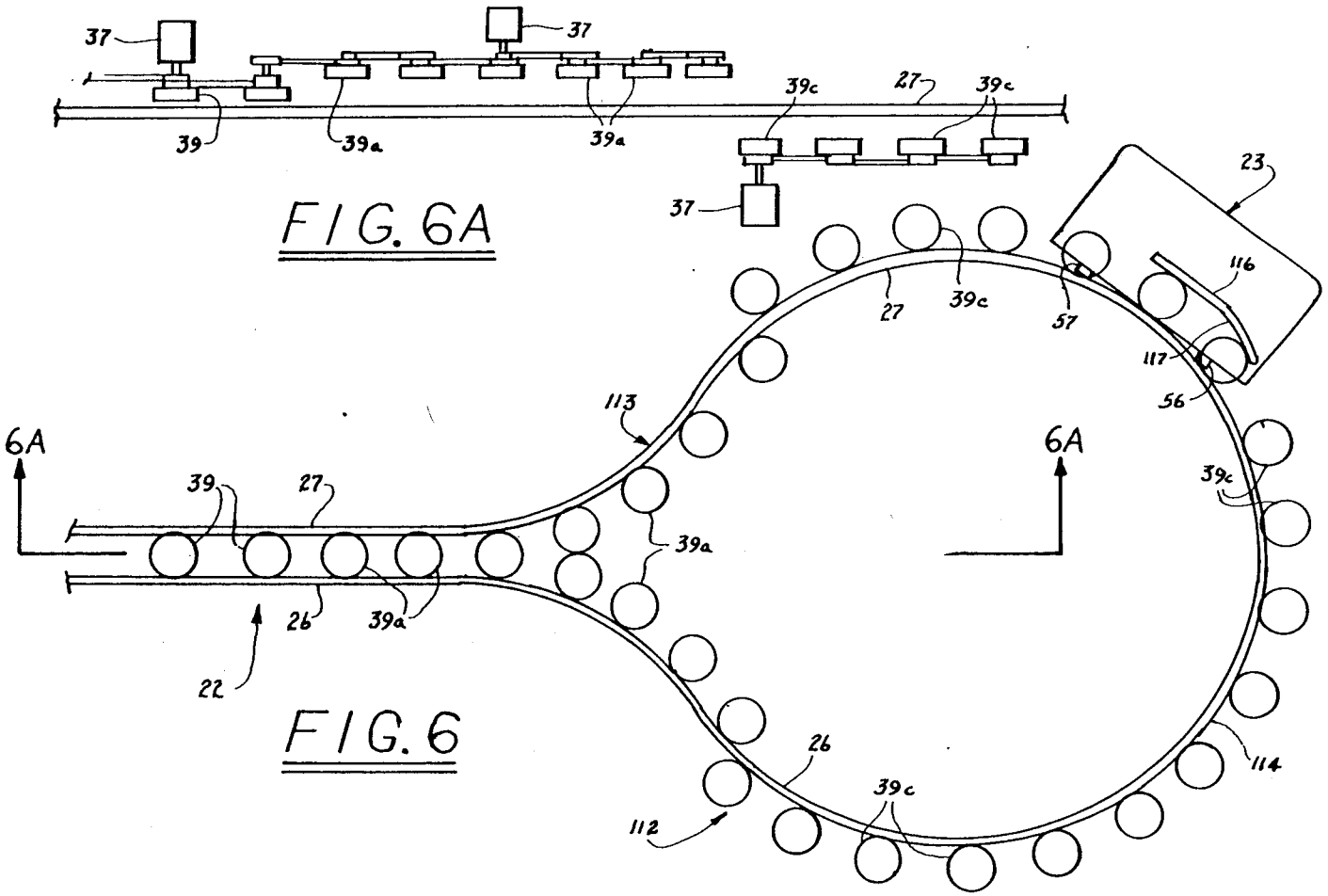
FIG. 6 is an enlarged, top plan view of one of the loop portions of the transportation course of FIG. 5.
FIG. 6A is a side elevation view taken substantially along the plane of lines 6A—6A of FIG. 6.

FIGS. 5 and 6 illustrate people mover courses or track layouts in which most of the length of the rail structure is formed for two-way driving of units on either side of the rail. The layout of FIG. 5, however, employs loops 111 and 112 at ends of the track layout in order to allow the carrier units to be driven from one side of the rail around the loops to the other side of the rail. As will be appreciated, it would be possible to gain many of the advantages of the system of the present invention without having a looped rack. Thus, a shuttle system could be employed and/or switching, but the people mover apparatus of the present invention is particularly well suited for making horizontal curves of a relatively tight radius. Accordingly, providing loops at the ends of the track can be accomplished without excessive area being required to provide a continuously circulating system.

As best may be seen in FIG. 6, driving of passive carrier units 23 around loop 112 can be accomplished by simply providing a separate support structure for each of rail 26 and 27. Rails 26 and 27 are, in layouts with looped ends, merely rail sections of a single continuous rail. Driving of the passenger carrier units along the rail can be accomplished in convex portions 113 by engaging the usual drive shoe assembly 43 with constant speed drive wheels 39 or acceleration/deceleration drive wheels 39*a*. Once the load carrier unit 23 reaches convex portion 114 of loop 112, however, a straight drive shoe surface will not be engaged effectively by the drive wheels. It is preferable to provide the carrier units with an auxiliary shoe structure 116, which may be advantageously positioned beneath the frame 67 and curved inwardly so that drive wheels 39*c* will remain in engagement with the curved surface 117 of shoe 116 during transport around convex portion 114 of the reversing loop.

Further auxilliary propulsion force can be applied to passenger carrier units 23 by a drive wheel 39*d* (FIG. 7) which engages a longitudinally extending drive shoe surface 118 along the top of the carrier unit. The primary disadvantage of this approach is that the frictional contact between drive wheel 39*d* and surface 118 depends upon either resilient mounting or biasing of drive wheel 39*d* toward surface 118 or resilience inherent in a pneumatic or flexible covering of the drive wheel. Gravity does not assist in the frictional driving force between wheel 39*d* and surface 118 to any significant degree.

Stations

Stations, such as 46, 47 and 48, in the people mover system of the present invention preferably include a plurality of drive wheels 39 which operate at very slow speeds through the stations. Thus, the accelerator/decelerator on either side of the stations brings the carrier units down to virtually an inching speed, at which point the car doors 81 and 83 automatically open. The drive wheels in the station inch carrier unit 23 along the length of the station at a very slow speed to permit safe entry and exit to the unit while moving slowly in the station. This allows even the drive wheels in the stations to be coupled by transmission means 91 to the other drive wheels in the system.

Alternatively, drive wheels 39 which are not belted to the remainder of the system can also be provided but are independently operable so that they can receive a carrier unit from the accelerator/decelerator, advance it slightly, stop the unit for boarding and unloading and then advance the unit to the exit accelerator/decelerator. The time which units can be stopped in the station is determined by the length of the cabin 69 for a carrier unit divided by the time interval between units on the steady, maximum speed sections on the rail means 22.

In systems employing a steady, slow-speed inching of the carrier unit through the station, it would also be possible to evenly space the carrier units along rail means 22 and then eliminate one of the units. The unit preceeding the space left by the removed unit can dwell or stop in the station long enough to board and unload handicapped passengers and those with special boarding problems. The necessary limit switches and controls for special handling of the carrier units for handicapped persons in the stations can be provided so that the overall system can still be operated automatically and without operators in each of the carrier units.

Method Of Transporting Passengers and Cargo

In a first aspect, the method of the present invention includes the step of supporting a load carrier 23 cantilevered from a side of the rail structure 22 so as to gravity induce a moment biasing the carrier unit about the support rail into driving contact with drive means 24 associated with the rail. Thus, the cantilevered supporting of the carrier unit from a side of the rail causes the unit to swing inwardly toward a plurality of drive wheels oriented generally perpendicularly to the inside wall 86 of the carrier unit so as to engage the carrier unit, and particularly a drive shoe assembly 43 thereof. This insures positive propulsion and control of the motor of car 23 along rail structure 22.

In another aspect, the method of the present invention includes the step of driving a load carrier unit 23 along opposite sides of rail 22 by a common drive wheel 39 formed and dimensioned to engage the unit on both sides of the rail and apply driving forces in opposite directions. While the entire length of the course may not be constructed for two-way propulsion of units, it is an important feature of the system of the present invention that units are driven along opposite sides of at least a portion of the course. This is accomplished by employing a rail assembly having a relatively narrow width dimension and drive wheels which are dimensioned to span laterally across the rail assembly so that the same drive wheel will engage units on either or both of opposite sides of the rail to propel the cars in opposite directions along opposite sides of the rail.

In still a further aspect of the method of the present invention, passive passenger and cargo carrier units are propelled along a rail structure by the steps of positively coupling a plurality of drive motors together by power transmission means. Additionally, slaving of the motors together for operation as a unit allows ease of control and enhances safety. The combination of positive coupling of the motors by power transmission means and slaving the motors together by control means affords a transportation system which can be readily automated with minimum controller costs.

Example of System

The people mover system of the present invention is designed to fill the gap between slow moving belt-type walkways and high speed complex monorail or light-rail trolley systems. Thus, the present system generally operates at only moderate speeds, for example, with a top speed under about 25 miles per hour and most preferably at about 1200 feet per minute (slightly more than 13.6 mph). In a one mile long looped track of the type shown in FIG. 5 ($\frac{1}{2}$ mile on each side) fifteen passenger carrier units 23 would be positioned at about 350 feet headways, with each unit being capable of carrying twelve to fourteen passengers while standing. The minimum radius of curvature of the track loops would preferably be about 4 meters (13 feet), and driving motors 37 would be provided as D.C. motors (or where electrical noise is permissible, an A.C. motor) having about 75 to 100 horsepower connected by power transmission means to drive a set of 15–20 drive wheels. The cost of construction of such a system would be between 1.5 and 3 million dollars per mile and it would have a maximum capacity over the length of the line of approximately 3000 people per hour.

What is claimed is:

1. A positive drive assembly for a wheel-powered, light-cabin, people mover system having rail means, a load supporting carrier unit movably mounted to said rail means, and drive means associated with said rail means and engaging and driving said unit along said rail means, wherein the improvement in said drive assembly comprises:

said unit carries drive shoe means oriented to extend along said rail means, said drive means includes a plurality of drive wheels mounted proximate said rail means in a position to engage and propel said unit, and said drive shoe means and alternating ones of said drive wheels being formed with mating teeth means for positive driving of said unit along said rail means, said alternate ones of said drive wheels having teeth means and being sufficiently spaced apart to prevent engagement of more than one of said drive wheels having teeth means with said shoe means at any time.

2. In an automatic people mover system for conveying passengers or cargo including, support means extending along a course over which conveying is to be effected; a plurality of passive, unpowered, light-cabin cars supported by said support means for movement along said course; and drive means including a plurality of side-by-side drive wheels positioned along said support means in relatively spaced-apart relation and positioned to sequentially engage and propel said cars along said course, wherein the improvement in said people mover system comprises:

said cars each being formed with a shoe assembly extending along said cars at a position to be engaged by said drive wheels;

at least a first set of said drive wheels positively interengaging said shoe assembly and positively driving said cars along said support means;

a second set of said drive wheels slidably engaging said shoe assembly and frictionally driving said cars along said support means; and said first set of said drive wheels and said second set of said drive wheels being positioned along said support means so that only one drive wheel of said first set of said drive wheels is in positive driving interengagement with said shoe assembly at any time.

3. The people mover system as defined in claim 2 wherein, said first set of drive wheels are each formed with teeth, and said shoe assembly is formed with mating teeth;

said first set of drive wheels are positioned to alternate with said second set of drive wheels over at least a portion of said course; and said shoe assembly has a length dimension less than the shortest distance between any two wheels having teeth to prevent positive driving engagement of said shoe assembly by two drive wheels having teeth.

4. A method of positively driving a passive carrier unit along a transport support structure by a plurality of drive wheels comprising the steps of:

engaging and positively driving said carrier unit along said transport support structure by two drive wheels formed to positively interengage and drive said carrier unit and spaced apart by a sufficient distance to prevent simultaneous engagement of said carrier unit by both of said two drive wheels; and slidably engaging and frictionally driving said carrier unit from a first of said two drive wheels to a second of said two drive wheels by a drive wheel positioned intermediate said two drive wheels and formed to frictionally engage said carrier unit.

* * * * *